US005330054A

United States Patent [19]

Brown

[11] Patent Number: 5,330,054

[45] Date of Patent: Jul. 19, 1994

[54] BEVERAGE BOTTLE WITH FINGERGRIPS

[75] Inventor: Harvey J. Brown, Dix Hills, N.Y.

[73] Assignee: Get A Gripp II Inc., Hauppauge, N.Y.

[21] Appl. No.: 987,877

[22] Filed: Dec. 9, 1992

Related U.S. Application Data

[63] Continuation-in-part of Ser. No. 642,428, Jan. 17, 1991, abandoned.

[51] Int. Cl.[5] ..... B65D 1/02; B65D 23/08; B65D 23/10

[52] U.S. Cl. ..... 206/459.5; 215/100 A; 215/365; 220/771

[58] Field of Search ..... 215/1 R, 12.2, 100 A, 215/365; 220/771; 40/310; 206/459.5

[56] References Cited

U.S. PATENT DOCUMENTS

| | | | |
|---|---|---|---|
| D. 64,152 | 3/1924 | Sweeney | D9/541 X |
| D. 69,097 | 12/1925 | Schwenck | D9/557 |
| D. 72,961 | 6/1927 | Mas | D9/557 |
| D. 91,653 | 3/1934 | Guyer | 215/1 R X |
| D. 94,341 | 7/1935 | D'Addario | D9/557 X |
| D. 112,798 | 1/1939 | Watson | D9/557 X |
| D. 119,801 | 4/1940 | Dallas | D9/557 X |
| D. 136,224 | 8/1943 | Hector | D9/557 X |
| D. 171,605 | 3/1954 | Livingston | D9/557 X |
| D. 172,010 | 4/1954 | Dillon | D9/557 |
| D. 183,040 | 6/1958 | Du Pree | D9/557 X |
| D. 185,881 | 8/1959 | Fuerst | D9/541 X |
| D. 187,302 | 2/1960 | Campbell | D9/541 X |
| D. 197,355 | 1/1964 | Green et al. | D9/541 X |
| D. 198,407 | 6/1964 | Busch | 215/1 R X |
| D. 214,158 | 5/1969 | Pettengill | D9/100 |
| D. 221,133 | 7/1971 | Wikke et al. | D9/45 |
| D. 238,656 | 2/1976 | Marco | D9/100 |
| D. 240,593 | 7/1976 | Koenigsberg | D9/116 |
| D. 249,329 | 9/1978 | Schacher et al. | D9/45 |
| D. 250,574 | 12/1978 | Boyle | D9/108 |
| D. 269,500 | 6/1983 | Bit | D9/350 |
| D. 272,521 | 2/1984 | Glenn | D9/370 |
| D. 277,551 | 2/1985 | Kerr | D9/370 |
| D. 278,682 | 5/1985 | Khalifa | D9/398 |
| D. 279,167 | 6/1985 | Haney et al. | D9/378 |
| D. 292,378 | 10/1987 | Brandt et al. | D9/396 |
| D. 294,463 | 3/1988 | Lang | D9/392 |
| D. 300,511 | 4/1989 | Cramer | D9/396 |
| D. 308,335 | 6/1990 | Rubinoff | D9/396 |
| 184,593 | 11/1876 | Curtice | 40/310 X |
| 1,832,806 | 11/1931 | Dawson | 215/1 R |
| 1,982,282 | 11/1934 | Bock | 40/310 X |
| 2,022,520 | 11/1935 | Philbrick | 215/1 R |
| 2,035,404 | 3/1936 | Quinn | 215/1 R |
| 2,119,546 | 6/1938 | Knaggs | 40/310 X |
| 2,893,678 | 7/1959 | Homan et al. | 215/1 R X |
| 3,185,353 | 5/1965 | Mercier | 222/206 |
| 3,403,804 | 10/1968 | Colombo | 215/31 |
| 3,468,648 | 9/1969 | Nowak | 215/1 R X |
| 3,536,223 | 10/1970 | Muhlhoff et al. | 215/1 C |
| 3,871,541 | 3/1975 | Adomaitis | 215/1 C |
| 4,749,092 | 6/1988 | Sugiura et al. | 215/1 C |
| 4,804,097 | 2/1989 | Alberghini et al. | 215/100 A |
| 4,838,464 | 6/1989 | Briggs | 222/478 |
| 4,885,809 | 12/1989 | Muchmore | 4/259 |
| 4,890,752 | 1/1990 | Ota et al. | 215/1 C |
| 5,156,285 | 10/1992 | Zogg et al. | 215/100 A |
| 5,158,190 | 10/1992 | Sosenko | 215/1 R |

FOREIGN PATENT DOCUMENTS

| | | | |
|---|---|---|---|
| 551475 | 1/1958 | Canada | 215/1 R |
| 871253 | 3/1953 | Fed. Rep. of Germany | 215/1 R |
| 2819768 | 11/1978 | Fed. Rep. of Germany | 215/1 R |
| 958908 | 3/1951 | France | 215/1 R |
| 2528389 | 12/1983 | France . | |
| 311999 | 10/1935 | Italy | 215/1 R |
| 614859 | 12/1948 | United Kingdom | 215/1 R |

*Primary Examiner*—Sue A. Weaver
*Attorney, Agent, or Firm*—Kenyon & Kenyon

[57] ABSTRACT

A beverage bottle having fingergrip indentations which facilitate grasping and holding of the bottle without slipping. The location of the fingergrips in relation to a label bearing a brand name affords a high degree of brand name visibility in environments where consumption of the contents is directly from the bottle. Special geometry of the fingergrip indentations permits high speed filling of the bottles with beer without excessive turbulence and foaming.

18 Claims, 5 Drawing Sheets

BEVERAGE BOTTLE WITH FINGERGRIPS

This application is a continuation-in-part of application Ser. No. 07/642,428, filed on Jan. 17, 1991 abandoned.

BACKGROUND OF THE INVENTION

The invention relates to a beverage bottle having fingergrips, and more particularly to a beer bottle having fingergrips which are specially adapted to permit high speed filling of the bottle without excessive beer foaming.

The typical beverage bottle consists of a hollow vessel with a narrow mouth for holding and carrying liquids. While not particularly designed to facilitate the consumer to drink the contents directly from the bottle, it has become increasingly popular in recent years for consumers to walk around holding the bottles and sipping the contents. Young people today are very active and very often drink their beverages while on the go, or in conversation standing up, or even while engaged in other physical activities.

Since the contents of a bottle is typically cold, such as cold beer or soda, condensation results in the formation of dew on the outside of the bottle. One of the drawbacks associated with drinking the contents directly from such a bottle is this dew which causes the bottle to become slippery. This problem is exacerbated when the beverage bottles are stored in an ice cooler where ice slush clings to the bottles as they are removed from the cooler.

In an attempt to solve this problem, beverage bottles have been provided with rough outer surfaces. For example, U.S. Pat. No. 3,403,804 and Design U.S. Pat. No. 308,335 describe beverage bottles whose outer surface is etched with a multiplicity of closely spaced ridges. Although the presence of such ridges improves the grip which one can apply on the bottle, slipperiness of the outer surface remains a problem. Furthermore, the presence of these ridges interferes with labelling of the bottle.

It is known to provide heavy jugs containing, for example, cider or wine with fingergrips to facilitate lifting and holding of the jug and the pouring of its contents. For example, Design U.S. Pat. No. 91,653 to Guyer illustrates a jug having four fingergrips on one side and a thumbgrip disposed on the opposite side of the jug. However, such fingergrips have not been provided for single serving beer bottles, which are slender and light compared to cider jugs.

One of the major problems which would have been encountered in providing fingergrips in beer bottles, if such an attempt were ever made prior to the present invention, is the excessive product foaming which occurs during conventional high speed filling of such bottles. In state of the art filling processes, air is drawn out of the bottle and beer is injected radially from a filling tube inserted in the top of the bottle. As the beer hits the inner surface of the bottle, it flows down the surface in an annular stream. During this process, some foam is generated, however, the amount of foam does not impede the process.

On the other hand, upon filling a beer bottle having fingergrip and thumbgrip indentations, such as those illustrated in the Guyer patent, excessive product foaming occurs which results in beer spewing out of the top of the bottle and an incomplete fill.

SUMMARY OF THE INVENTION

It is an object of the invention to provide a single serving beverage bottle, such as a beer bottle, having fingergrips which do not impede filling of the bottle.

It is a further object of the invention to provide a beverage bottle which can be securely gripped, notwithstanding the presence of slippery dew and/or slush on the outside of the bottle.

It is yet a further object of the invention to provide a beverage bottle which affords a high degree of label visibility when the consumer drinks the contents directly from the bottle.

I have discovered that ordinary fingergrip indentations, such as those illustrated in Design U.S. Pat. No. 91,653 to Guyer, are responsible for problematic foaming of beer during a conventional filling process. The pronounced shape and size of the indentations of these fingergrips along the inside of the bottles are such that they create a waterfall effect, as the annular stream of beer passes over them. In other words, the shape and size of the indentations direct the downwardly flowing stream of beer toward the interior of the bottle at an angle which is great enough to cause the beer to cascade over the indentations and fall away from the inner surface of the bottle to which it normally clings. The agitation and turbulence which results causes excessive foaming which, at the end of the fill, spews beer out of the bottle opening.

In accordance with the invention, both the fingergrip indentations and the non-indented regions between adjacent fingergrips along the inner surface of the bottle are arcuate in the direction down the side of the bottle. In other words, if a cross section of the bottle is viewed, the side having the fingergrips will resemble a flat smooth wave from top to bottom. In this way, the transition between adjacent indentations is arcuate and smooth so that beer flowing down the bottle is less likely to cascade over the indentations and more likely to cling to the inner surface of the bottle. Furthermore, the maximum extent to which the fingergrip indentations may project into the interior of the bottle at the apex, so as to avoid problematic beer foaming, is about 0.125 inches.

The bottle preferably includes four arcuate fingergrip indentations disposed along one side of the bottle and a brand name label or painted product information on the opposite side of the bottle. In this way, as a consumer will be inclined to pick the bottle up by gripping the fingergrips, the opposite side of the bottle bearing the brand name will ordinarily be exposed to view.

DETAILED DESCRIPTION OF THE INVENTION

Figure 1:
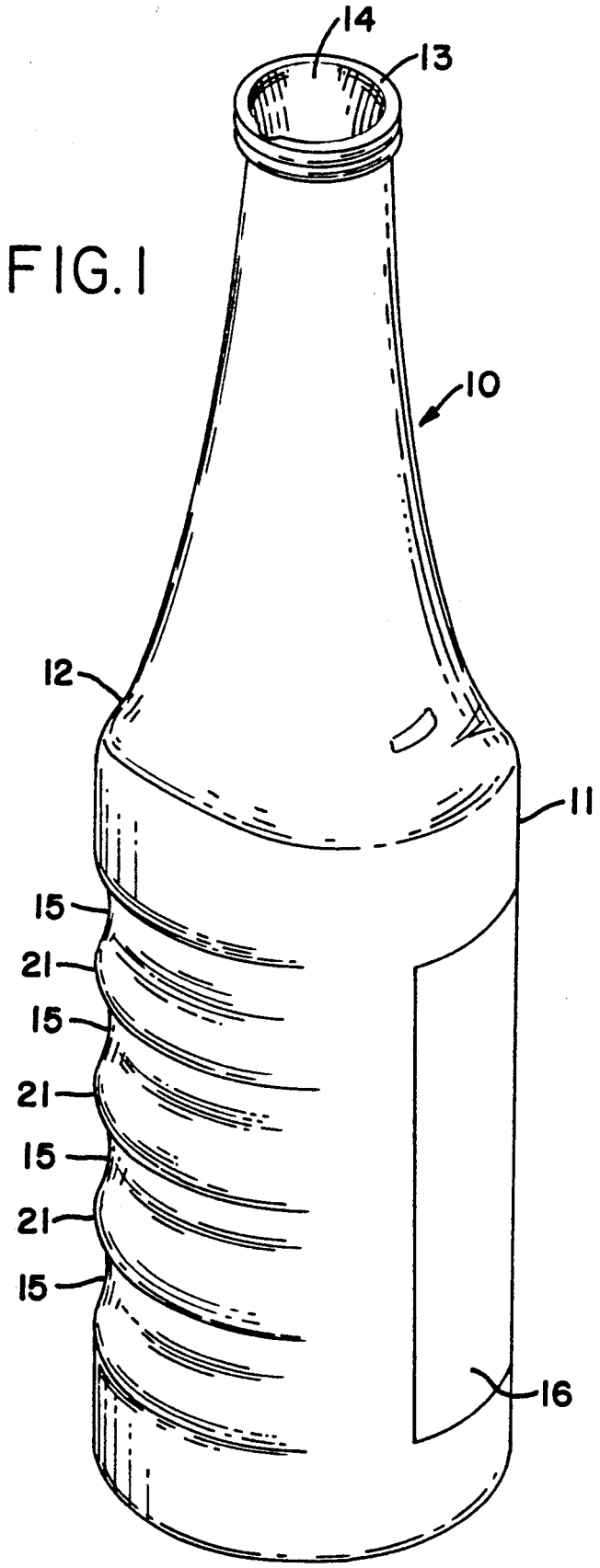
FIG. 1 is a perspective view of a bottle in accordance with the invention.
Figure 2:
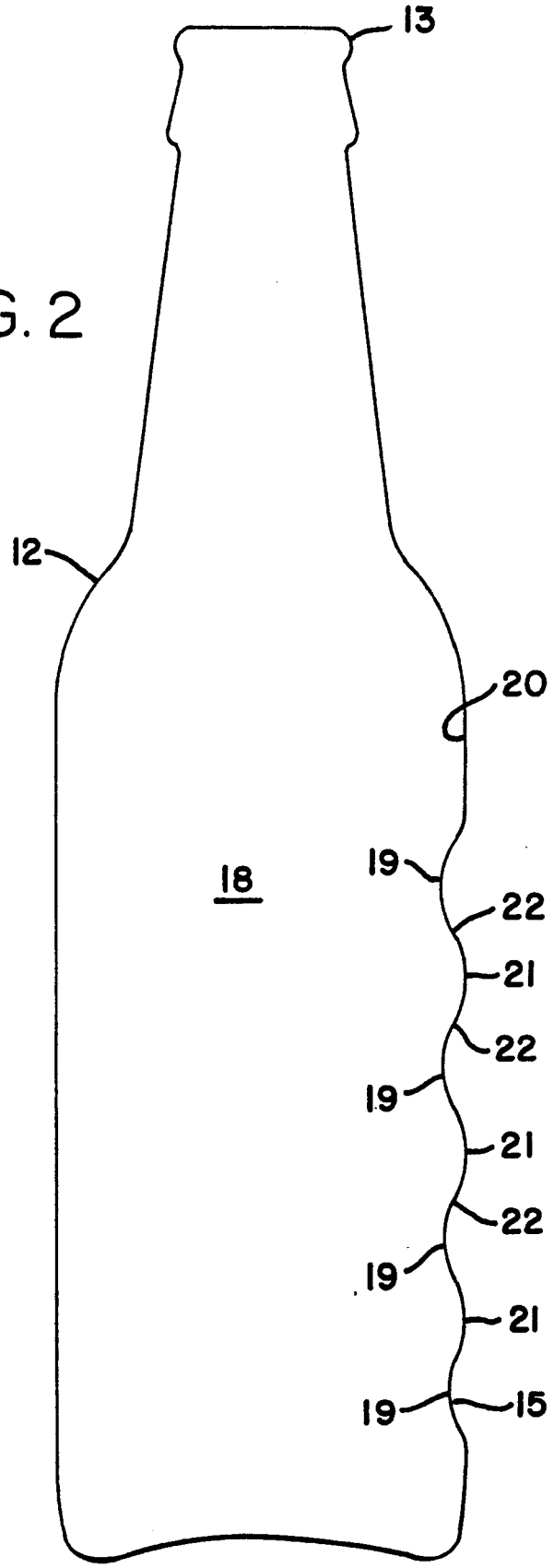
FIG. 2 is a cross-sectional view of the bottle illustrated in FIG. 1.

Referring to FIGS. 1 and 2, bottle 10 consists of a main body 11 with a neck section 12 which narrows down to a lip 13 which forms bottle opening 14. The outer circumference of lip 13 is circular to take a conventional bottle cap or crown as is understood in the art. Bottle 10 is intended to contain carbonated or non-carbonated beverages which are to be drunk directly from the bottle.

Bottle 10 is configured with a plurality of parallel, spaced ribs or fingergrip indentations 15. Preferably, there are four fingergrips 15, disposed one directly above another along one side of the bottle as illustrated. These fingergrip indentations 15 can be provided during molding of the bottle using conventional cavity molding techniques. The fingergrips 15 run along at least a portion of the circumference of bottle 10, preferably less than 180° around the circumference to allow for better sealing of two bottle halves during cavity molding. The spaced fingergrip indentations 15 are intended to correspond to the fingers of a person holding the bottle lined up with the fingergrips. The purpose of fingergrips 15 is to make it easier to grasp bottle 10, holding it more lightly than heretofore possible, without the bottle slipping through the hands as a result of dew or slush on the bottle.

Figure 4:
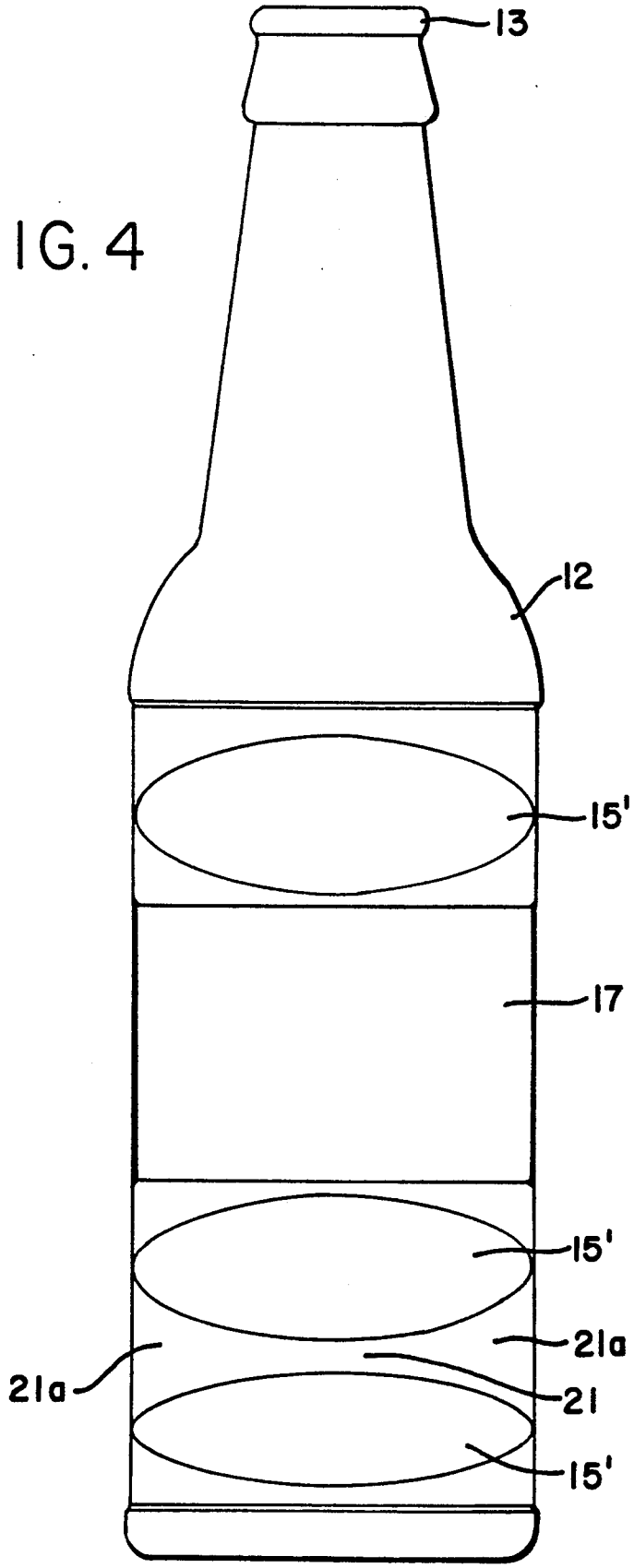
FIG. 4 is a planar view of another embodiment of the invention.

The opposite side of bottle 10, i.e., the side opposite the fingergrip indentations 15, preferably is not configured with any fingergrip or thumbgrip indentation so as to allow room for a label 16 which identifies the contents of the bottle by brand name and possibly provides other product information. As known in the art, label 16 may be dispensed with by painting or printing the brand name directly on the outer surface of the bottle. Since a consumer will be inclined to grasp bottle 10 using the fingergrip indentations 15, it will be appreciated that the invention necessarily affords a high degree of label and brand name visibility, particularly in a bar setting where beer is commonly sipped directly from the bottle. As the consumer holds the bottle by fingergrip indentations 15, the label 16 or painted brand name located on the opposite side of the bottle 10 is necessarily exposed to public view, increasing the advertising effect of the label 16. This is an important advantage of the present invention which results from the location of the fingergrips 15 on only one side of the bottle 10.

Where it is desired to extend a label completely around the circumference of bottle 10 (i.e., 360°), the embodiment of the invention illustrated in FIG. 4 may be employed. In this embodiment, the label 17 extends 360° around the bottle in an area which is configured without any fingergrip indentations. For this purpose, the bottle 10 may be configured with only three fingergrips so as to allow room for the bigger label 17. Preferably, the brand name is printed on the side of the label which is opposite the fingergrips 15 for the advertising effect described above.

In the case of beer bottles in accordance with the present invention, the shape and the size of the indentations are important in avoiding excessive product foaming during conventional high speed filling processes wherein beer is injected radially toward the sides of the bottle. Referring to FIG. 2 which is a cross-sectional view of a beer bottle in accordance with the invention, it can be seen that each fingergrip indentation 15 projects into the interior 18 of bottle 10 so as to define an arcuate mound 19 along the inner surface 20 of the bottle. The areas of the bottle which separate adjacent fingergrip indentations 15 which are not recessed (from the outer surface of the bottle) are designated by reference numeral 21. In accordance with the invention, it is important that these non-recessed areas 21 interface with adjacent arcuate mounds 19 along the inner surface of the bottle so as to define smooth and arcuate transitions 22 at the interface. In this way, mounds 19 and areas 21 along the inner surface 20 of the bottle will define a smooth flat wave when viewed in cross-section as illustrated in FIG. 2. This is an important feature of the invention as it applies to beer bottles, because the smooth wave pattern defined along the inside of the bottle will not create any waterfall effect as to beer flowing down the side of the bottle during a conventional high speed filing process. Rather, the beer will substantially cling to the inner surface of the bottle as it traverses over smooth mounds 19.

Figure 3:
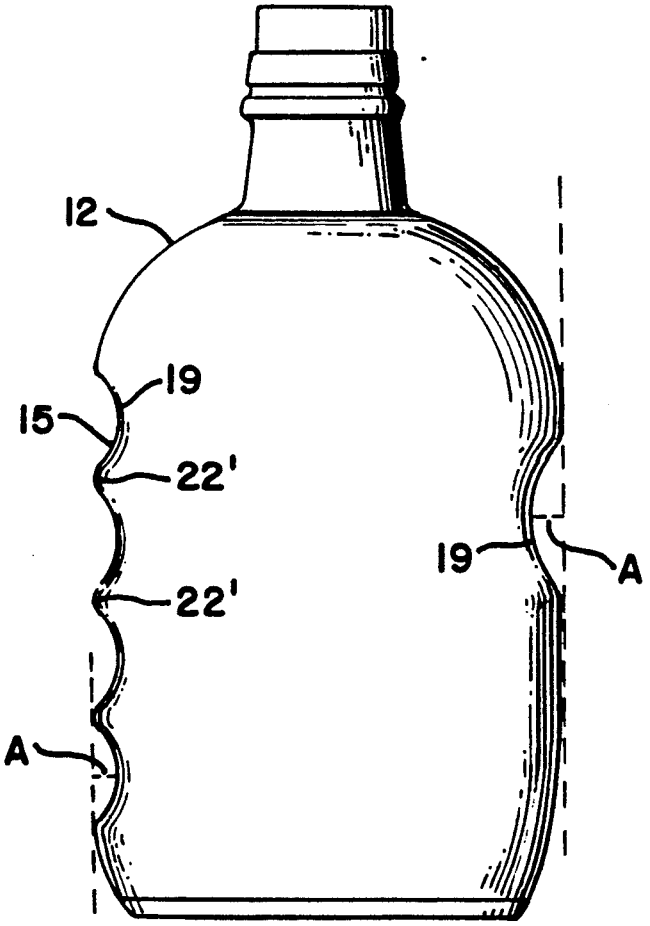
PRIOR ART FIG. 3
FIG. 3 is a cross-sectional view of a bottle having fingergrips which will result in problematic excessive foaming of beer during a conventional state of the art high speed filling process.

On the other hand, where the transition points 22 at the interface between mounds 19 and adjacent areas 21 are not arcuate, both rather are angular or peaked, as illustrated for example in FIG. 3 at 22' and in Design U.S. Pat. No. 91,653 to Guyer, a significant waterfall effect takes place as beer flows over the mounds during filling. As discussed above, the turbulence resulting from the cascading beer generates excessive foam which urges beer to spew out from the top of the bottle at the end of the fill. This is an unacceptable result which is avoided by the special configuration of the fingergrips of the present invention.

In addition to the shape and contour of the mounds 19 and the areas 21 between the mounds, the amplitude or maximum height of each mound 19, as measured between the apex of each mound and the base thereof is an important parameter in avoiding excessive foaming. The amplitude (i.e., the depth of finger indentations 15) is designated by the letter A in FIG. 3. In the case of standard size single-serving beer bottles which are typically about 9 inches tall and about 2,375 inches in diameter in their non-tapered region, the amplitude A of the mounds 19 may be up to about 0.125 inches without causing unwanted excessive foam during a conventional filling process. It has been found that this dimension is more of a critical parameter for the top and second from the top of the fingergrip indentations than it is for the lower two fingergrips because any waterfall effect caused by the lower fingergrips does not result in as much turbulence as cascading beer from the top two fingergrips. Therefore, the lower two mounds 19 may have an amplitude somewhat greater than about 0.125 inches without significantly impeding the filling process. Nevertheless, the depth of the lower fingergrips generally need not be as deep as the depth of the upper fingergrips since the lower grips need only accommodate the thinner fingers of the hand.

Figure 5:
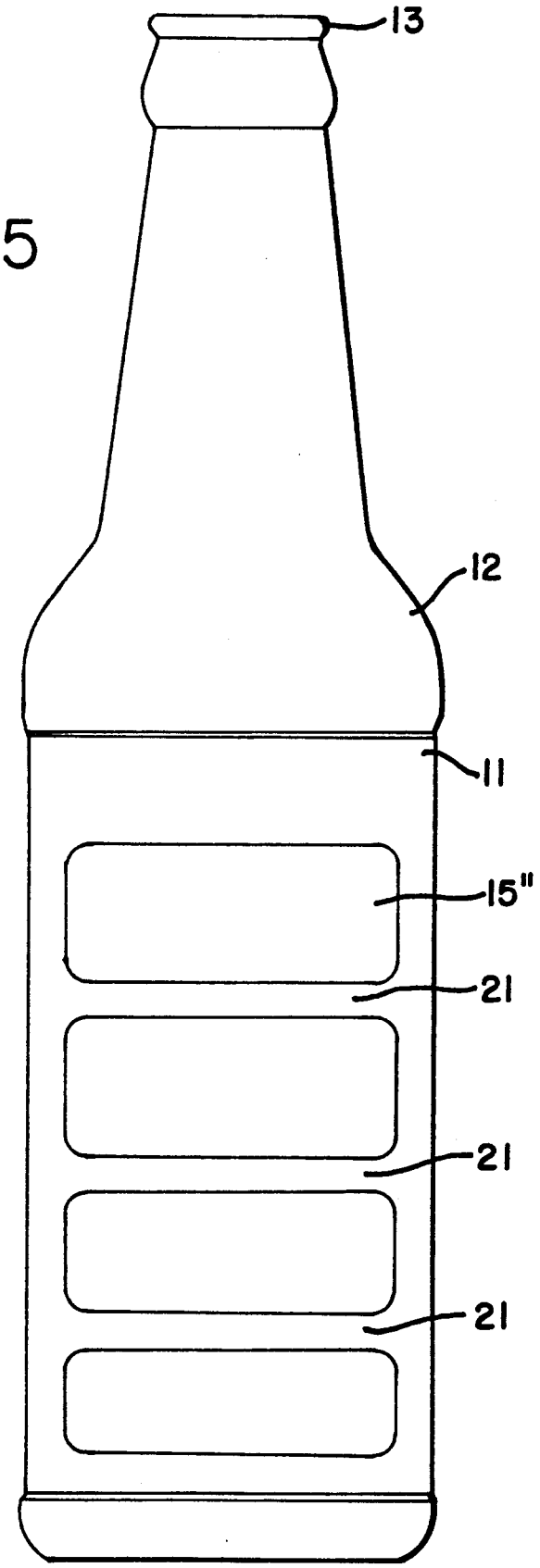
FIG. 5 is a planar view of yet another embodiment of the invention.

It can be seen from the planar view of FIG. 4 that the fingergrip indentations 15' may be eliptical in shape. However, in another embodiment illustrated in FIG. 5, the indentations 15'' are substantially rectangular in shape so that the non-recessed areas 21 which separate adjacent fingergrip indentations are of a constant uniform span width along the circumference of bottle 10. In the embodiment of the invention illustrated in FIG. 4, it can be seen that the non-recessed areas 21, **21*a* between adjacent fingergrip indentations 15 are not of constant uniform width along the circumference of the bottle; the portion of each non-recessed area 21*a* between the ends of the fingergrip indentations 15 is wider than the portion of each non-recessed area 21 between the central region of the fingergrip indentations. The embodiment of the invention illustrated in FIG. 5 induces less foaming than the embodiment illustrated in FIG. 4 because less turbulence is created as beer flows over the areas 21** of uniform width.

EXAMPLE

Beer bottles in accordance with the invention as illustrated in FIG. 2 were filled with beer using a standard VKV valve used by Krones, Inc. of Franklin, Wis. The filling method employed, which is standard in the bottling industry, involves: positioning the vent tube of the filling apparatus into the bottle neck; removing about 90% of the air in the bottle; equalizing the pressure in the bottle with that which exists in the bowl head space in the valve; and flowing beer down the outside of the vent tube where it is propelled radially toward the inner surface of the bottle by a liquid spreader. The annular stream of beer flows down along the inner surface of the bottle to fill the bottle. When the level of beer reaches the vent tube, the emission of gas from the vent tube stops automatically, thereby stopping the flow of product. At this point, the valve is closed and the bottle is shifted or vented back to atmospheric pressure.

A bottle in accordance with the invention as illustrated in FIG. 2 was filled using this method. The maximum depth of the top two fingergrip indentations (i.e., the amplitude A) was about 0.125 inches. The maximum depth of the third from the top fingergrip indentation was about 0.109 inches. The maximum depth of the bottom fingergrip indentation was about 0.093 inches. When five of these bottles were filled using the above-described method, a typical and commercially acceptable foam head consistently formed at the top of the bottle at the end of each fill. The small foam head results from $CO_2$ released during the fill and it is desirable because it expels oxygen.

The filling described above was compared with the filling of another bottle whose top fingergrip indentation had a maximum depth of 0.156 inches, rather than 0.125 inches. The dimensions of the other fingergrip indentations were the same, and the bottle was the same in all other respects. Five separate fills of this bottle were attempted. In three of the five attempts, pronounced turbulence was observed as the beer flowed over the fingergrips which resulted in an unacceptable amount of foam spewing from the top of the bottle at the end of each fill. The other two attempts resulted in an acceptable foam head.

This comparative example demonstrates the importance of the depth of the uppermost of the finger indentations in consistently avoiding excessive foaming during filling. In high speed brewery filling operations, it is imperative to obtain smooth consistent fills. Inconsistent fills cause inconsistent fobbing or jetting of the bottles which can result in high air pickup and high beer losses. Additionally, turbulence during the fill causes additional air pickup, which results in loss of shelf life.

What is claimed is:

1. A hand grippable bottle for holding a beverage which can be securely grasped and which affords a high degree of beverage product information visibility while being hand held, comprising: a slender bottle having a main body closed at one end by a base and a neck extending from an opposite end of the main body, and a beverage contained in the bottle, said neck being tapered in a direction toward an open end of the neck where said neck terminates, said main body having a plurality of finger indentations formed therein, arranged on a first side of the main body, suitable for receiving a corresponding plurality of a person's fingers to facilitate grasping and holding of the bottle without slipping, the individual finger indentations of said plurality being separated from each other by adjoining non-indented regions of the main body, said main body having a second side, opposite the first side, which does not define any finger indentations and which bears information as to the beverage contained in the bottle.

2. The beverage bottle according to claim 1 wherein the information is a product name.

3. The beverage bottle according to claim 1 wherein the information is a brand name for the beverage to be contained in the bottle.

4. The beverage bottle according to claim 1 wherein the information is borne on a label which is attached on an outer surface of the second side of the main body.

5. The beverage bottle according to claim 4 wherein the label extends at least partially over a non-indented region of the first side of the main body.

6. The beverage bottle according to claim 1 wherein the information is printed or painted directly on an outer surface of the second side of the main body.

7. The beverage bottle according to claim 1 wherein the main body has a cylindrical periphery and wherein the plurality of finger indentations extend less than 180° around the periphery.

8. The beverage bottle according to claim 7 wherein the information extends less than 180° around the periphery.

9. The beverage bottle according to claim 1 wherein the first side of the main body has an inner surface which defines a smooth arcuate transition region between each of said finger indentations and their adjoining non-indented regions.

10. A hand grippable bottle for holding beer which can be filled by flowing an annular stream of beer over an inner surface of the bottle without causing the stream of beer to cascade away from the inner surface prior to the stream reaching the fill level, comprising: a slender bottle having a main body closed at one end by a base and a neck extending from an opposite end of the main body, said neck being tapered in a direction toward an open end of the neck where said neck terminates, said main body having a plurality of finger indentations formed therein suitable for receiving a corresponding plurality of a person's fingers to facilitate grasping and holding of the bottle without slipping, the individual finger indentations of said plurality being separated from each other by adjoining non-indented regions of the main body, the bottle having a smooth inner surface which is characterized by a smooth, arcuate wave-like contour in the region of the main body formed with the finger indentations, said smooth, arcuate wave-like contoured inner surface permitting a stream of beer to flow along it, during filling of the bottle in a vertical position, without causing the stream of beer to cascade away from the inner surface of the bottle prior to the stream reaching the fill level, wherein the finger indentation located closest to the bottle neck has a maximum depth of no greater than about 0.125 inches.

11. The bottle according to claim 10 wherein the finger indentation has a maximum depth of no greater than about 0.125 inches.

12. The bottle according to claim 10 wherein the finger indentation located closest to the bottle neck has a maximum depth of no greater than about 0.093 inches.

13. The bottle according to claim 10 wherein the main body is cylindrical in shape and wherein the finger indentations extend less than 180° around the periphery of the main body.

14. The bottle according to claim 13 wherein said adjoining non-indented regions have a constant span width separating adjacent finger indentations along the periphery of the main body.

15. The bottle according to claim 13 further comprising a label which bears a beverage brand name thereon, the label being attached to an outer surface of side of the bottle which is opposite to the finger indentations.

16. The bottle according to claim 10 wherein said adjoining non-indenting regions have a constant span width separating adjacent finger indentations along the periphery of the main body.

17. The bottle according to claim 16 wherein each of said adjoining non-indented regions has the same span width separating adjacent finger indentations.

18. The bottle according to claim 10 wherein the main body bears product information on a side of the bottle which is opposite to the finger indentations.

* * * * *